US005133644A

United States Patent [19]

Barr et al.

[11] Patent Number: 5,133,644

[45] Date of Patent: Jul. 28, 1992

[54] MULTI-PRESSURE COMPENSATION OF VARIABLE DISPLACEMENT PUMP

[75] Inventors: Stephen W. Barr, Marlow; Joseph B. Crump; Timothy D. Rice, both of Duncan, all of Okla.

[73] Assignee: Halliburton Company, Duncan, Okla.

[21] Appl. No.: 642,482

[22] Filed: Jan. 17, 1991

[51] Int. Cl.[5] ..... F04B 49/00

[52] U.S. Cl. ..... 417/218; 417/53

[58] Field of Search ..... 417/218, 222 R, 53

[56] References Cited

U.S. PATENT DOCUMENTS

| | | | |
|---|---|---|---|
| 3,788,775 | 1/1974 | Leutner et al. | 417/222 R |
| 3,903,698 | 9/1975 | Gellatly et al. | 60/453 |
| 3,959,969 | 6/1976 | Tittmann et al. | 60/445 |
| 4,022,021 | 5/1977 | Russell, Jr. | 60/420 |
| 4,123,907 | 11/1978 | Bianchetta et al. | 60/445 |
| 4,157,233 | 6/1979 | Horiuchi | 417/218 |
| 4,468,173 | 8/1984 | Dantlgraber | 417/220 |
| 4,523,431 | 6/1985 | Budzich | 60/431 |
| 4,801,247 | 1/1989 | Hashimoto et al. | 417/218 |
| 4,958,989 | 9/1990 | Frantz | 417/222 R |

*Primary Examiner*—Richard A. Bertsch
*Assistant Examiner*—David W. Scheuermann
*Attorney, Agent, or Firm*—James R. Duzan; E. Harrison Gilbert, III

[57] ABSTRACT

A variable displacement pump is controlled throughout a broad range of operating conditions between a maximum pressure, low flow rate combination and a minimum pressure, high flow rate combination even when the pump is driven by a power limited prime mover. Different relief valves set at different operating pressures are automatically selectably connected to a control port of the pump in response to the actual flow rate of the fluid pumped by the pump reaching different flow rate set points.

14 Claims, 4 Drawing Sheets

MULTI-PRESSURE COMPENSATION OF VARIABLE DISPLACEMENT PUMP

BACKGROUND OF THE INVENTION

This invention relates generally to a multi-pressure compensation system, apparatus and method for variable displacement pumps. In a particular aspect of the invention, a pressure control port of a variable displacement hydraulic pump is controlled so that the pump pumps a fluid at pressure and flow rate combinations within the range between a maximum pressure, minimum flow rate combination and a minimum pressure, maximum flow rate combination without exceeding the maximum power output of a prime mover driving the pump, which maximum power output is less than the power which would be needed for the pump to pump the fluid at a maximum pressure, maximum flow rate combination.

Fluid energized equipment such as can be used in the oil and gas industry, for example, is commonly connected to and energized by a single power pack containing a variable displacement pump which pumps the fluid to energize the equipment. The power pack also includes a prime mover, such as a diesel engine, which drives the pump. The hydraulically actuated equipment is typically connected in parallel to the variable displacement pump. Each equipment is usually connected through a throttling valve or electrohydrauic valve which controls the pressure applied to the equipment, thereby regulating the speed of the equipment. An illustration of this arrangement is shown in FIG. 1 wherein the fluid energized equipment is shown as loads $\mathbf{2}_1$, $\mathbf{2}_2$, . . . $\mathbf{2}_n$ connected through throttling or electro-hydraulic valves $\mathbf{4}_1$, $\mathbf{4}_2$, . . . $\mathbf{4}_n$, respectively, to a hydraulic power pack 6. By way of example, the loads 2 might include hydraulically driven motors, metering pumps and sand screws.

The loads 2 typically require a higher pressure to get started than they need to continue running once started. For example, a starting pressure might be 2,500 pounds per square inch (psi) and a running pressure might be 1,000 psi. At the starting pressure a relatively low fluid flow rate is typically needed, but at running pressure a relatively high fluid flow rate is typically needed.

The pressure applied to a particular load 2 is controlled by the respective valve 4, but the primary system pressure is delivered by the variable displacement pump of the power pack 6. When the primary system pressure is greater than the pressure applied to a load, there is a pressure drop across the respective valve 4. Such a pressure drop generates excess heat which is wasted energy. Normally, however, the variable displacement pump must be set for the worst case pressure requirement, i.e., high start-up pressure to start the loads. Therefore, after start-up, the variable displacement pump provides more pressure than is needed and the excess pressure is converted to the aforementioned excess heat. This excess heat puts an additional load on the power pack cooling system.

The typical variable displacement pump used in the above-described system has been operated at a limited operating range so that once set for the worst case pressure requirement, it could not vary much to reduce the system pressure and thereby reduce the throttling valve pressure drop and resultant excess heating. That is, such a pump typically has been set to accommodate the high pressure, low flow rate combination of operating conditions needed for load start-up; but has not been controlled to provide low pressure, high flow rate combinations of operating conditions once the loads have come on line and been started. The pump could be preset to provide low pressure and high flow rates, but then it would not accommodate the start-up conditions (an example of the operating range for such a limited setting is shown in FIG. 5 by the lines 7 of short dashes). Current applications in at least the oil and gas industry need more flexibility than this type of operating range limited system can provide.

One way to improve the operating range of the variable displacement pump would be to use a larger prime mover which can provide "corner power," i.e., sufficient power to drive the pump to provide maximum pressure and maximum flow rate. This, however, requires a heavier and costlier prime mover which cannot always be accommodated. Furthermore, this larger capacity is not needed at any one setting of the variable displacement pump, but is only needed to provide the overall expanded operating range.

Another way to try to improve the operating range of the variable displacement pump driven by a power limited prime mover is with a mechanical "horsepower compensation" spool from Parker Hydraulics. Testing was conducted on this, but it did not provide for constant output power and it was not adjustable over a wide enough range. A graph of an example of the flow versus pressure characteristics of the compensation by the Parker horsepower compensation spool is shown by line 8 in FIG. 5.

Thus, there is the need for an apparatus which can control a variable displacement pump to operate over a wider operating range of pressure and flow rate combinations even when the pump is driven by a power limited prime mover having a maximum power output below the "corner power." There is the need for an overall pumping system and method within which a variable displacement pump provides fluid flow at pressure and flow rate combinations throughout a range between maximum pressure, minimum flow rate and minimum pressure, maximum flow rate without requiring the prime mover to have enough power to drive the pump simultaneously at maximum pressure and maximum flow rate.

SUMMARY OF THE INVENTION

The present invention overcomes the above-noted and other shortcomings of the prior art by providing a novel and improved apparatus and related system and method wherein a variable displacement pump can operate between a maximum pressure, minimum flow rate combination and a minimum pressure, maximum flow rate combination with a power limited prime mover.

The present invention gives a greater operating range, and thus greater flexibility, to a variable displacement pump driven by a power limited prime mover. This provides for safer working conditions because peak pressure is used only at start-up. This invention makes more efficient use of the limited power output which is available. The present invention reduces waste heat in parallel operated hydraulic systems. This provides for longer system life, decreased maintenance and reduced fatigue of system components. This also allows smaller heat exchangers to be used in the cooling system. A control apparatus of the present invention can be retrofitted to existing variable displacement pumps and pumping systems, and the cost of the apparatus is minimal compared to the cost of a new or higher horsepower pump or prime mover. The present invention attains these advantages without requiring a prime mover that provides corner power.

The apparatus of the present invention controls a variable displacement pump having a pressure responsive control port. The apparatus comprises pressure setting means for setting a selectable pressure limit at the pressure responsive control port; flow select means for selecting a plurality of flow rates at which the valve means is to be operated; and control means for operating the pressure setting means to select a pressure limit for the pressure responsive control port in response to the flow select means and the actual flow rate of a flow from the pump. In the preferred embodiment, each of the plurality of flow rates of the flow select means is the flow rate defining a constant power output with a respective one of the selectable pressure limits of the pressure setting means.

The pumping system of the present invention provides a pressurized fluid flow at pressure and flow rate combinations within the range between a maximum pressure, minimum flow rate combination and a minimum pressure, maximum flow rate combination. The system comprises a pressure compensated variable displacement pump having a pressure responsive control port; a flow meter connected to an output of the pump; valve means, connected to the control port of the pump, for defining a plurality of pressure limits for the control port; and means, connected to the flow meter and the valve means, for operating the valve means to select which of the pressure limits is communicated with the control port of the pump in response to the flow meter indicating fluid is being pumped by the pump at one of a plurality of predetermined flow rates. In the preferred embodiment, the pumping system further comprises a prime mover connected to the pump, which prime mover provides a maximum power output less than the corner power which would be needed to provide the pressurized fluid at a maximum pressure, maximum flow rate combination. In the preferred embodiment, each of the predetermined flow rates is the respective flow rate requiring maximum power from the prime mover for the pressure limit to be communicated to the control port for flow rates less than that respective flow rate.

The method of the present invention operates a variable displacement pump within the power limits of a prime mover but throughout a range of pressure-flow rate combinations. The method comprises monitoring the flow rate of a flow pumped by the variable displacement pump; and limiting the maximum pressure at which the pump pumps the flow in response to the monitored flow rate. In the preferred embodiment, limiting the maximum pressure includes operating the pump at a higher maximum pressure until the monitored flow rate reaches the flow rate at which the power limit of the prime mover is reached and then operating the pump at a lower maximum pressure.

Therefore, from the foregoing, it is a general object of the present invention to provide a novel and improved apparatus and related system and method wherein a variable displacement pump can provide pressures and flow rates throughout the range between a maximum pressure, minimum flow rate combination and a minimum pressure, maximum flow rate combination even when the pump is driven by a power limited prime mover. Other and further objects, features and advantages of the present invention will be readily apparent to those skilled in the art when the following description of the preferred embodiment is read in conjunction with the accompanying drawings.

DETAILED DESCRIPTION OF PREFERRED EMBODIMENT

Figure 1:
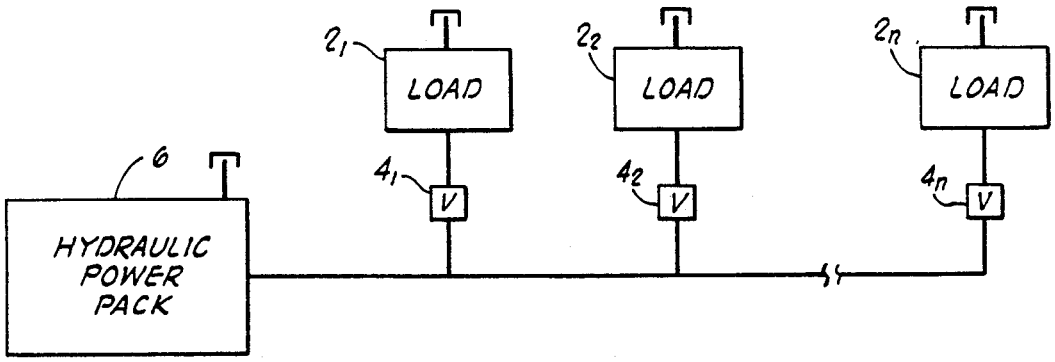
FIG. 1 is a block diagram of a parallel hydraulic system energized by a hydraulic power pack in which the present invention can be used.

The preferred embodiment of the present invention is adapted to be used in the hydraulic power pack 6 shown in FIG. 1 and referred to above. This finds particular application in the oil and gas industry, but the present invention is not necessarily limited thereto.

As an overview, the preferred embodiment pumping system of the present invention includes a series of electrically selectable relief valves to set system operating pressure, a hydraulic flow measurement device such as a turbine flow meter, and an electronic control device. Each relief valve determines system operating pressure by maintaining a set pressure on a pressure responsive control port of a variable displacement pump. The electronic control device determines which relief valve is active based on input from the hydraulic flow measurement device and preset inputs defining flow rate set points.

In this manner, different hydraulic pressures can be maintained for different hydraulic flow rates without ever requiring more power than the prime mover is capable of delivering. This means that high hydraulic pressures are available at low hydraulic flows, medium pressures are available at medium flows, and high flows are available at low pressures.

Starting at a maximum pressure, no flow condition, as the flow rate increases to a level where al of the available prime mover power is consumed, the electronic control device engages a different, lower pressure, relief valve to reduce the system pressure and amount of power consumed. As the system pressure is reduced, the amount of hydraulic flow available increases for a given amount of prime mover power. This process is repeated for additional lower pressure relief valves, with the number of pressure reduction steps being determined by the number of relief valves used.

By using variable setting relief valves and variable flow rate set point inputs to the electronic control device, the flexibility of this system is further enhanced by allowing it to be custom tailored for different applications.

Figure 2:
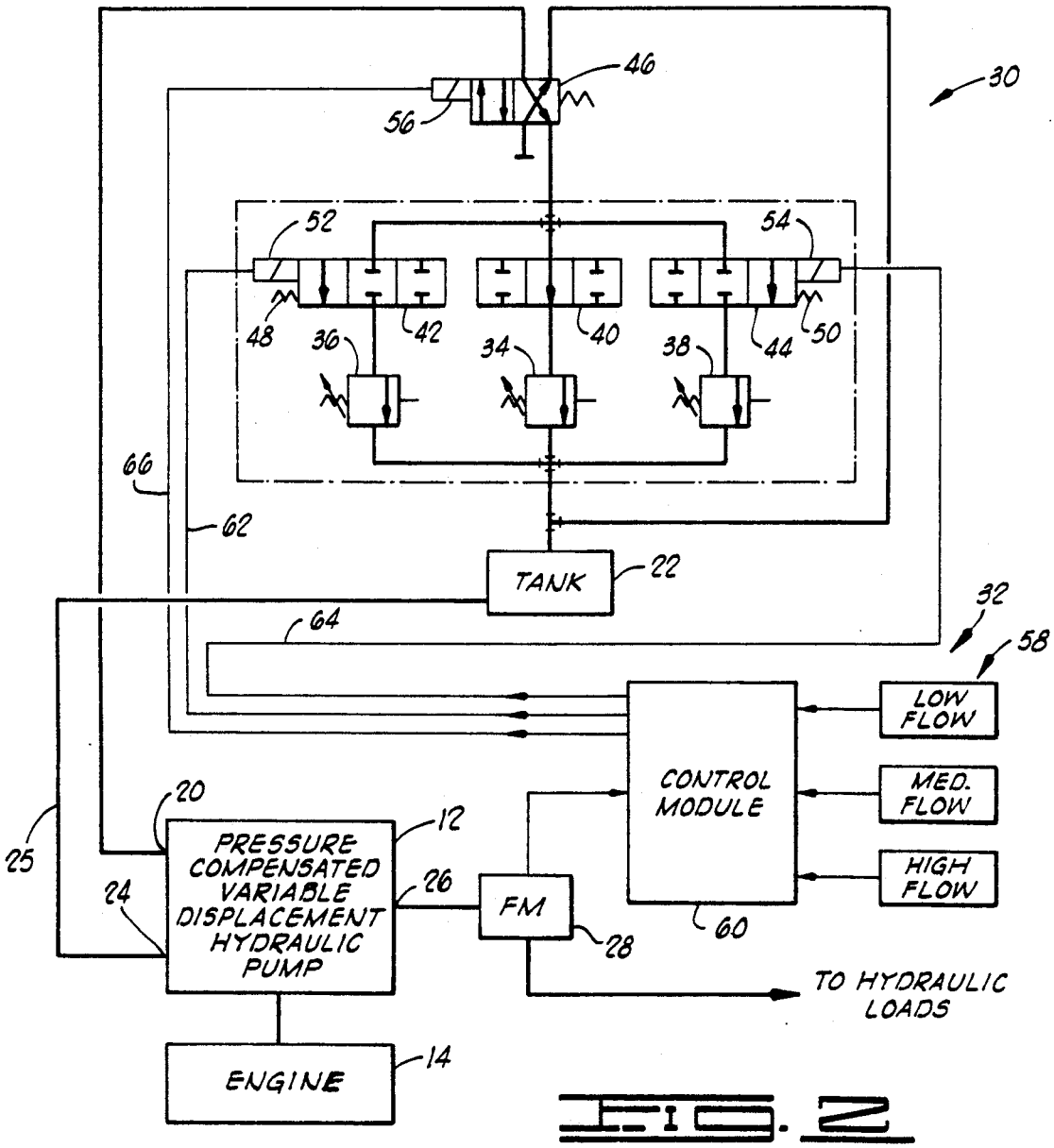
FIG. 2 is a combined schematic and block diagram of the apparatus and pumping system of the preferred embodiment of the present invention.

Referring primarily to FIG. 2, the preferred embodiment of the present invention will be more particularly described. The preferred embodiment pumping system includes a pressure compensated variable displacement pump 12. The pump 12 is driven by a prime mover 14 which provides a maximum power output less than the corner power which would be needed to provide the pressurized fluid output from the pump 12 at a maximum pressure, maximum flow rate combination of operating conditions. The corner power for the example shown in FIG. 5 (which will be further described hereinbelow) is marked by the reference numeral 16, and the constant maximum power output of the prime mover 14 is indicated by the line 18.

Both the pump 12 and the prime mover 14 are conventional in the preferred embodiment. For example, the pump 12 can be a Parker PAVC65 hydraulic pump and the prime mover 14 can be a Deutz F2L1011 diesel engine. The principal feature of note with regard to the pump 12 is that it includes an eternally accessible pressure responsive port 20 through which the pump output, and thus the system, pressure is set based on the back pressure held on the port 20. That is, the pump 12 pumps to whatever pressure is set at the port 20. What the pump 12 pumps at this pressure is fluid received from a reservoir or tank 22 connected to an inlet 24 of the pump 12 through a suction line 25. The pressurized fluid is output through an outlet 26 of the pump 12. The outlet 26 is connected through a flow meter 28 to the parallel connected branches of valves 4 and loads 2 represented in FIG. 1.

The flow meter 28 forms another part of the pumping system of the present invention. Any suitable type of flow meter can be used depending upon the type of hydraulic fluid used in the system. For applications in the oil and gas industry, for example, Halliburton Services turbine flow meters can be used. Regardless of the specific type to be used, the flow meter 28 of the preferred embodiment needs to provide an electrical signal output representative of the flow rate of the fluid pumped through the flow meter 28 by the pump 12. For example, the signal might have a frequency which varies directly with the flow rate of the fluid in the hydraulic line into which the flow meter 28 is connected. In the preferred embodiment, the flow meter 28 output signal is the single source of system feedback a control apparatus of the present invention uses to make its control decisions.

The pumping system of the present invention further comprises an apparatus for controlling the pump 12. This control apparatus, to which the aforementioned feedback signal from the flow meter 28 is provided, includes pressure setting means 30 and operating means 32.

The pressure setting means 30 is operated by the operating means 32 to set a selectable pressure limit at the pressure responsive control port 20 of the pump 12. In the embodiment shown in FIG. 2, the pressure setting means 30 includes valves for defining a plurality of pressure limits for the port 20. The depicted valves include relief valves 34, 36, 38; control valves 40, 42, 44; and primary control valve 46

Each of the relief valves 34, 36, 38 is set to open at a different respective maximum pressure. These opening pressures define the pump operating pressure limits. That is, if one of the relief valves 34, 36, 38 is in communication with the control port 20, the pump 12 will not pump to a greater pressure than the pressure at which the communicated relief valve opens. One port of each of the relief valves 34, 36, 38 is connected to the tank 22, and the other port of each of these valves is connected to a respective one of the control valves 40, 42, 44.

Each of the control valves 40, 42, 44 shown in FIG. 2 is a three-way valve with two blocked settings and one open setting as indicated by the schematic representations in FIG. 2. The valves are interconnected so that they operate in unison in response to the operating means 32 activating or deactivating solenoids 52, 54. For the depicted embodiment, the valves 40, 42, 44 are centered by springs 48, 50 when neither solenoid 52, 54 is energized. For this condition, the relief valve 34 is communicated through the open setting of the valve 40. When the solenoid 52 is energized and the solenoid 54 is not, the control valves 40, 42, 44 are shifted right as viewed in FIG. 2 so that the relief valve 36 is communicated through the open setting of the valve 42. When the solenoid 54 is energized and the solenoid 52 is not, the control valves 40, 42, 44 are shifted left as viewed in FIG. 2 so that the relief valve 38 is communicated through the open setting of the valve 44. Whichever relief valve 34, 36, 38 is communicated through the control valves 40, 42, 44, it may or may not be communicated to the pump control port 20 depending upon the status of the primary control valve 46.

The primary control valve 46 connects the control valves 40, 42, 44 to the pump control port 20. For the embodiment shown in FIG. 2, the valve 46 is a two-way valve having two positions. In the position shown in FIG. 2, the valve 46 communicates the other control valves, and thus the selected relief valve, with the pump control port 20. When a solenoid 56 of the valve 46 is energized, the valve 46 is shifted to the right as viewed in FIG. 2 so that the pump control port is blocked or closed. This causes the pump 12 to operate up to whatever pressure has been set by an internal valve within the pump 12, which internal valve is a part of the pump 12 as known in the art (as also known in the art, the pump 12 has an internal flow limiter which sets the maximum flow from the pump).

The valves 34–46 are conventional. For example, the relief valves 34, 36, 38 and the control valves 40, 42, 44 can be implemented by a Parker Model R2P8 tri-pressure valve, and the valve 46 can be implemented by a Parker D1VW 20H KF/312 solenoid valve.

The relief valves 34, 36, 38 operate automatically in response to the respective pressure limit being reached whereupon the respective valve opens; however, the control valves 40, 42, 44, 46 operate in response to the operating means 32. The means 32 operates the control valves to select which selectable pressure limit is communicated with pump control port 20. This is done in response to the flow meter 28 indicating fluid is being pumped by the pump 12 at one of a plurality of predetermined flow rates.

To set, and thereby predetermine with respect to the control apparatus, the plurality of predetermined flow rates, the operating means 32 includes flow select means 58. The flow select means 58 is any suitable means for entering a plurality of flow rate set points defining the flow rates at which the operating means 32 selects which of the relief valves 34, 36, 38 is communicated with the control port 20 of the pump 12. Examples of such set point entering means include thumbwheel switches and dials.

In the FIG. 2 embodiment, three flow rate set points are shown entered: a low flow rate, a medium flow rate and a high flow rate. The number of set points equals the number of external relief valve pressure limits in the illustrated embodiment. The set points selected for the preferred embodiment are the flow rates which, in conjunction with the respective pressure limits defined by the external relief valves 34, 36, 38 and the internal pressure and flow limiters within the pump 12, define a constant power output for the prime mover 14. This constant power output is at the maximum power of the prime mover 14 in the preferred embodiment.

In the preferred embodiment, each of the set point inputs is effected by dialing in three digits on a respective four-bit thumbwheel switch. Flow rates indicated by the numbers on these switches are given in gallons per minute, with precision to tenths of a gallon per minute. The lowest selectable set point is 00.0 and the highest is 99.9 (for present typical uses in the oil and gas industry, however, the maximum set point would likely be less than 50.0 gallons per minute).

To use the entered set points, the operating means also includes a control module 60 which is connected to the flow select means 58, the flow meter 28 and the solenoids 52, 54, 56. The control module 60 responds to the entered set points and to the actual flow rate as detected and indicated by the flow meter 28. When the actual flow equals one of the entered set points, the control module 60 activates or deactivates the control valves as needed. That is, the control module 60 includes means for comparing the set points with the actual flow rate for determining when a different relief valve is to be communicated with the control port 20. Control is provided by electrical signals on conductors 62, 64, 66 connected to solenoids 52, 54, 56, respectively. The primary function of the control module 60 is to keep the hydraulic power output below a predetermined level, namely, the maximum power output level from the prime mover 14 in the preferred embodiment.

Figure 6:
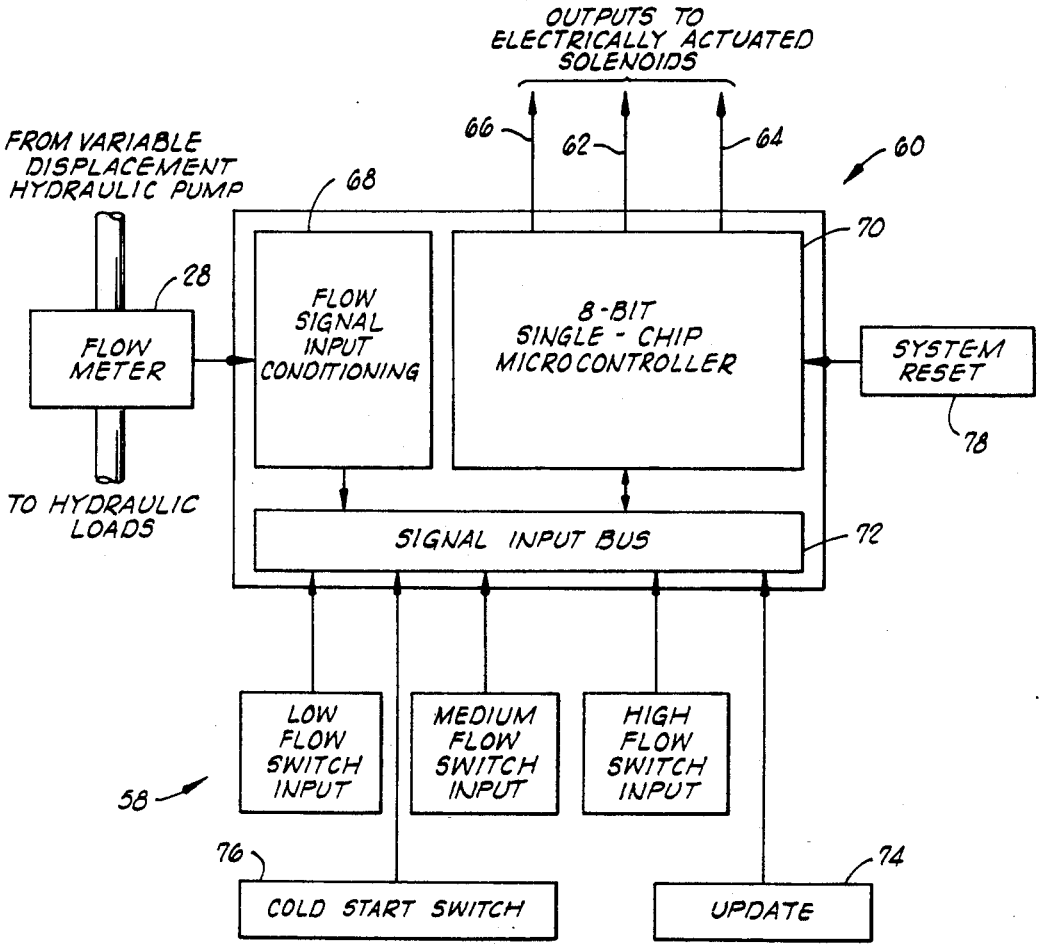
FIG. 6 is a functional block diagram of the preferred embodiment of an operating means of a control apparatus of the present invention.

Referring to FIG. 6, the preferred embodiment control module 60 includes flow signal input conditioning means 68, 8-bit single-chip microcontroller means 70 and signal input bus means 72.

The input conditioning means 68 includes low-pass filter circuitry, an amplifier, and a Schmitt trigger to ensure that the flow meter output signal will be readable by the microcontroller. The input conditioning means 68 can be constructed using known technology.

The microcontroller 70 is responsible for reading all operator inputs, monitoring the flow rate in the hydraulic line, and sending out three outputs based on the aforementioned information. The three outputs are sent to the electrically actuated solenoids 52, 54, 56. The three outputs can each have two states. A logic "0," or "low," being sent out means the solenoid receiving that signal will be deenergized. A logic "1," or "high," will energize the solenoid, and thus activate the control valve or valves. All memory is on-chip, reducing parts count. The flow rate, represented by a square-wave pulse train from the flow meter 28, is measured by means of an internal counter, which is switched on and off by an interrupt generated by an internal timer. The microcontroller means 70 can be constructed using known technology. Programming of the microcontroller means 70 can also be readily implemented using known programming skills to implement the control process described herein. In the preferred embodiment, the microcontroller 70 is an Intel 87C51.

The signal input bus means 72 is created by implementing five three-state buffers in parallel. Each conventional buffer manages two digits of the flow settings dialed in by the operator on the panel thumbwheel switches. The microcontroller 70 reads the dial settings by selecting each of these buffers in turn. There are nine digits altogether, so one of the five buffers manages only a single digit.

Also shown in FIG. 6 are an update switch 74, a cold start switch 76 and a system reset switch 78.

The update switch 74 is a pushbutton switch on the operator panel which must be pressed when the operator has dialed in new flow settings and wants the system to perform according to them. When this button is pressed, the microcontroller 70 reads in the new flow switch settings and adjusts system operation as necessary.

The cold start switch 76 is a toggle switch on the operator panel which, when on, activates the hydraulic pump's internal compensation valve. This enables the operator to get the hydraulic load moving from dead stop, utilizing very high pressure and very low flow.

The system reset switch 78 is a momentary pushbutton switch which forces the microcontroller 70 to restart execution of its internally stored microcode from the beginning. It would only be used in case of unknown difficulty or emergency, but is not to be considered a "kill" switch.

In operation, when the actual flow rate detected by the flow meter 28 is below the "low flow" set point, the control module 60 outputs a signal on the conductor 66 to energize the solenoid 56 and thereby shift the primary control valve 56 to the right as viewed in FIG. 2 to close the pump control port 20 and enable the pump 12 to operate to its maximum pressure in accordance with its internal setting. The conductors 62, 64 are controlled at this time to deenergize the solenoids 52, 54 so that the control valves 40, 42, 44 are centered by the springs 48, 50 as depicted in FIG. 2. This allows the pump 12 to provide fluid flow to the system at maximum pressure and minimum flow rate (and flow rates up to the "low flow" set point).

When the system flow rate detected by the flow meter 28 equals the "low flow" set point, the control module 60 deenergizes the solenoid 56 over the conductor 66 and maintains the solenoids 52, 54 deenergized. This opens the primary control valve 46 and connects the relief valve 34 to the pump control port 20. The relief valve 34 is set for a pressure less than the internal setting for the port 20, but still for a relatively high pressure. Thus, as among the external valves 34, 36, 38, this provides for a high pressure, low flow rate condition within the system.

When the system flow rate detected by the flow meter 28 equals the "medium flow" set point, the control module 60 keeps the solenoids 56, 54 deenergized, but energizes the solenoid 52 via the conductor 62. This communicates the relief valve 36 with the pump control port 20. This sets the pump 12 to operate at medium pressure, medium flow rate combinations.

When the system flow rate detected by the flow meter 28 equals the "high flow" set point, the control module 60 keeps the solenoid 56 deenergized, but deenergizes the solenoid 52 and energizes the solenoid 54. This communicates the relief valve 38 with the pump control port 20. This sets the pump 12 to operate at low pressure, high flow rate combinations.

Figure 5:
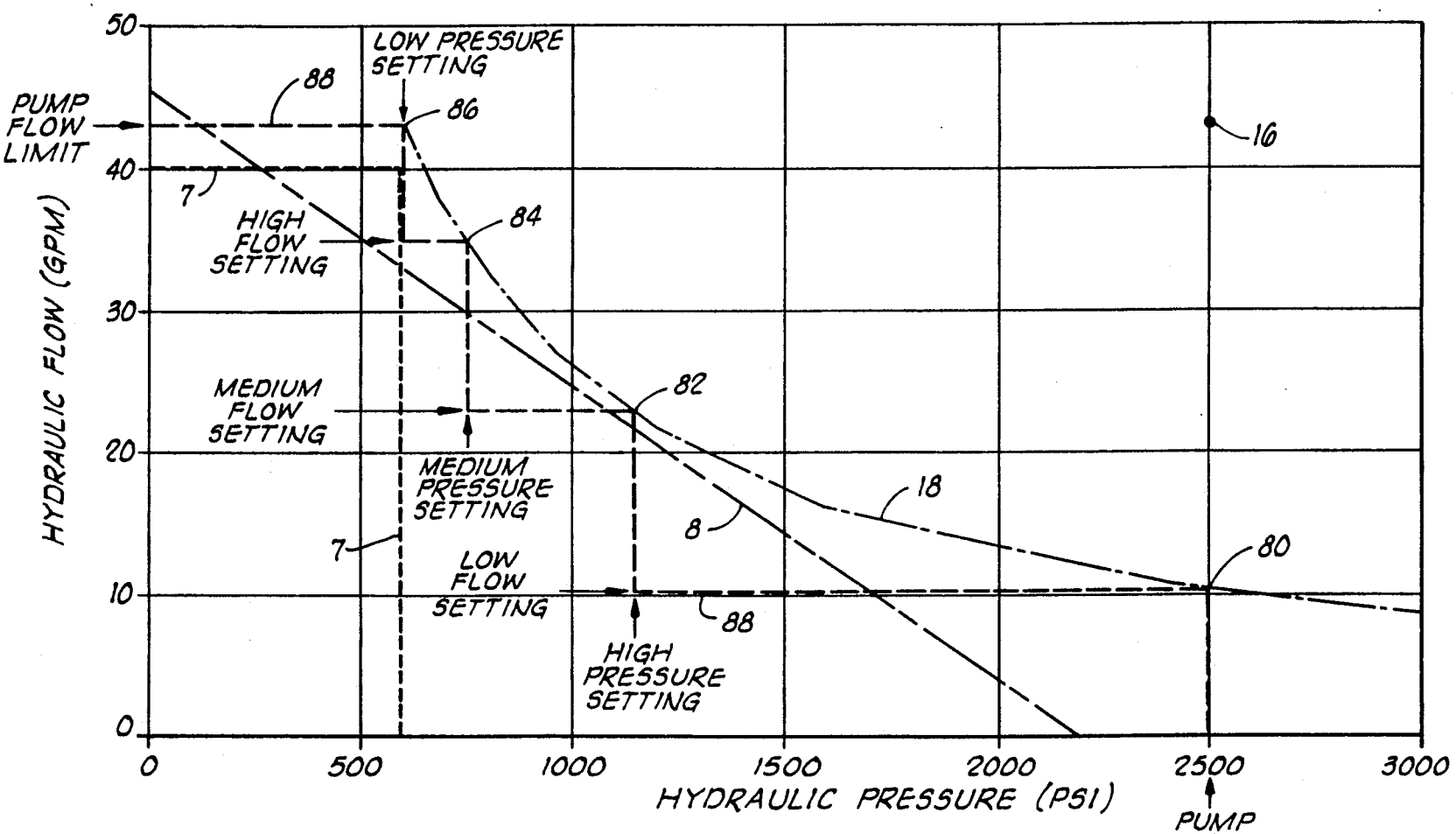
FIG. 5 is a graph showing the operating characteristics of the present invention in comparison with a single pressure compensated system and a partially compensated system.

Referring to FIG. 5, an example of the foregoing operation and response will be given. In the FIG. 5 example, the internal setting of the pump control port 20 is 2,500 psi and the "low flow" set point is substantially 10 gallons per minute (gpm); therefore, until the flow meter 28 indicates an actual flow of this "low flow" set point, the control module 60 keeps the primary valve 46 closed so that the pump 12 can pressurize the system up to 2,500 psi.

After this initial setting of the system, the control module 60 communicates the relief valve 34 with the pump control port 20 when the actual flow rate sensed by the flow meter 28 equals 10 gpm, thereby limiting the pump 12 to 1136 psi (the pressures listed throughout this example are rounded to the nearest whole number based on a constant (pressure)×(flow) product of 25,000 represented by the constant maximum power output curve 18). This occurs at point 80 in FIG. 5.

When the flow rate reaches the "medium flow" set point of 22 gpm, the control module 60 communicates the relief valve 36 with the pump control port 20. This limits the pump 12 to 714 psi. This occurs at point 82 in FIG. 5. Thus, up to point 82 the system is able to operate at 1136 psi from 10 gpm up to 22 gpm.

When the flow rate reaches the "high flow" set point of 35 gpm, the control module 60 communicates the relief valve 38 with the pump control port 20. This limits the pump 12 to 595 psi. This occurs at point 84 in FIG. 5. Thus, from 22 gpm up to 35 gpm the system can operate at 714 psi. When 35 gpm is reached, the system is limited to 595 psi and the system flow rate can increase to whatever the volume limiter of the pump 12 is set (e.g., 42 gpm at point 86 for the FIG. 5 example).

Thus, for the foregoing example the present invention enables the system to be operated throughout the full range between 2,500 psi (maximum pressure) with minimum flow rate and minimum pressure with 42 gpm (maximum flow rate). This operating range includes the area under the stepped curve defined by the lines 88 of long dashes in FIG. 5.

Figure 3:
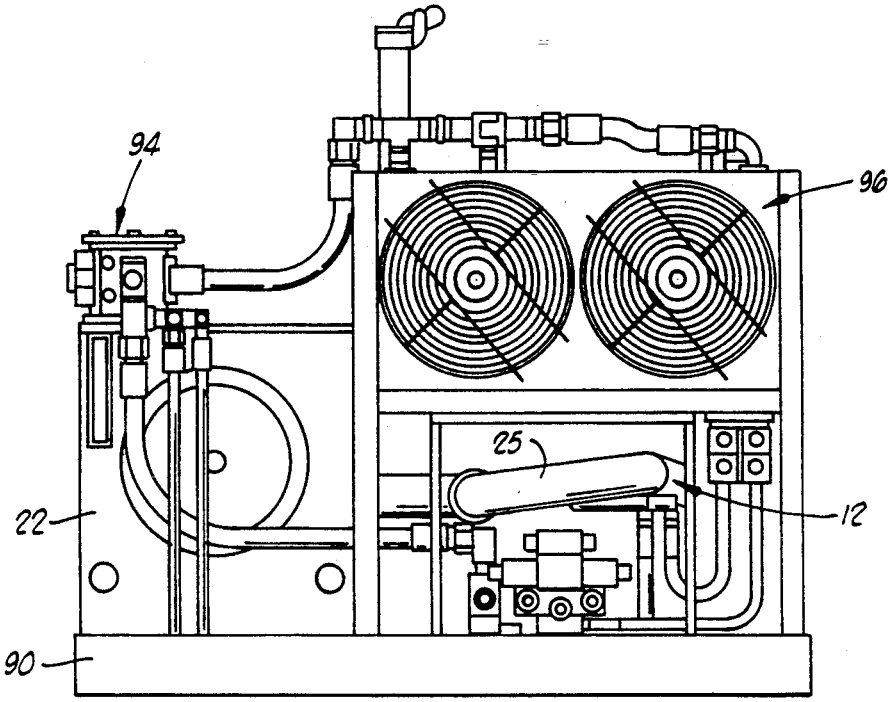
FIG. 3 is an elevational view of skid-mounted components of the preferred embodiment apparatus and pumping system.
Figure 4:
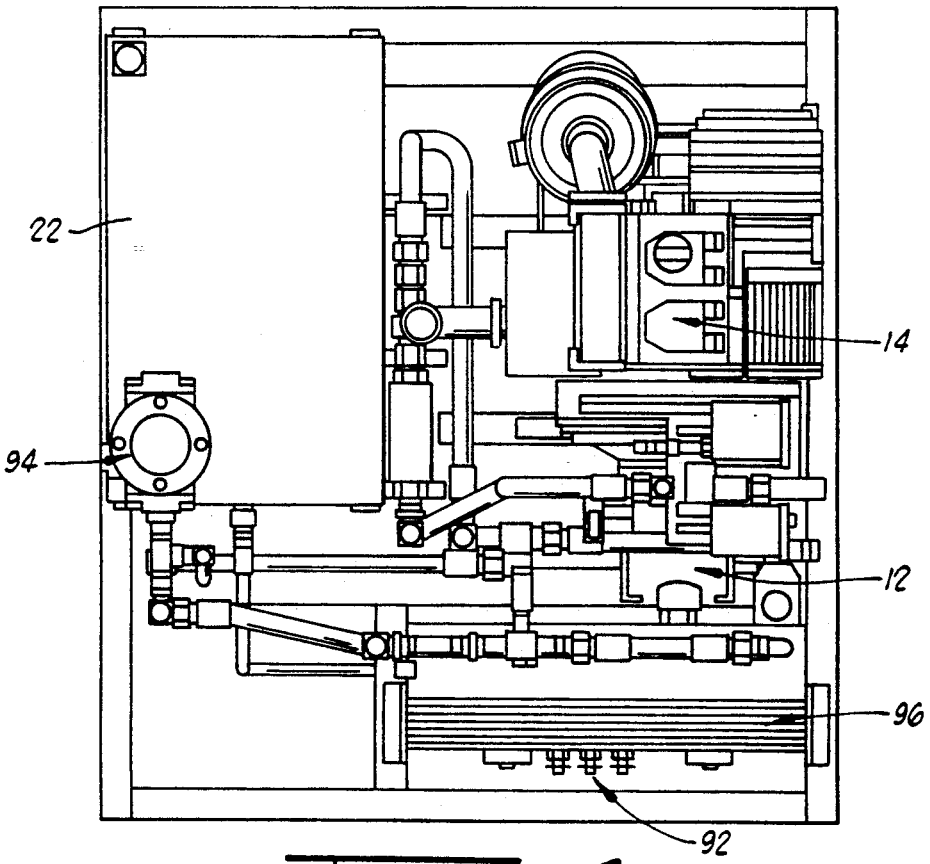
FIG. 4 is a plan view of the skid-mounted components.

Referring to FIGS. 3 and 4, components of the pumping system of the present invention can be mounted on a skid 90. Components from FIG. 2 identified in FIGS. 3 and 4 are labeled with the same reference numerals except that the valves 34–44 are contained within the one tri-pressure unit 92 in the implementation of FIGS. 3 and 4. Other components not previously identified include a return fluid filter 94 and a heat exchanger 96.

An additional feature which can be used with the embodiment described hereinabove is a quick idle valve (not shown) for bypassing the valves 34–46 to provide a minimum pressure path to the tank 22 for safety purposes or for when the pump 12 goes on idle. Other non-illustrated components of the preferred embodiment system include: a DC/DC converter for supplying logic level voltages from a 12–24 VDC automotive battery voltage; three logic level switchable power field effect transistors to handle solenoid actuation; and hysteresis adjustment, which is done by minor alteration of the microcode.

From the foregoing it is apparent that the present invention provides a method of operating a variable displacement pump throughout a broad range of pressure-flow rate combinations. It allows the pump to operate over this range even when the pump is driven by a power limited prime mover. In accordance with the foregoing description, the method comprises monitoring the flow rate of a flow pumped by the variable displacement pump, and limiting the maximum pressure at which the pump pumps the flow in response to the monitored flow rate. Limiting the maximum pressure includes operating the pump at a higher maximum pressure until the monitored flow rate reaches the flow rate at which the power limit of the prime mover is reached and then operating the pump at a lower maximum pressure.

The pressure limiting is obtained by selecting a plurality of flow rate set points at which the pump is to be limited to different respective maximum pressures; determining when the monitored flow rate equals one of the selected flow rate set points; and communicating one of a plurality of relief valves with a control port of the pump in response to determining the monitored flow rate equals one of the selected flow rate set points, each of the relief valves responsive to a different maximum pressure. As has been previously described, the pump is in this way set to operate up to a first maximum pressure and the actual flow rate output from the pump is monitored to determine when it equals the flow rate at which the power limit of the prime mover is reached for the first maximum pressure. When the flow rate reaches this point (e.g., point 80 in FIG. 5) as determined by a comparison within the microcontroller 70 of the control module 60, the pump is reset to operate up to a second maximum pressure less than the first maximum pressure by the control module 60 selecting the appropriate external relief valve and communicating it with the pump control port 20. The determination of the actual flow rate versus the set points and the resetting of the pump are repeated in like manner for the second and additional sequentially smaller maximum pressures down to a last maximum pressure a the monitored flow rate reaches each successive flow rate set point. Thus, the pump 12 is limited to sequentially smaller maximum pressures at points 82, 84 in the example of FIG. 5. In this way the pump provides flows at pressure and flow rate combinations between the first maximum pressure at a minimum flow rate and the last maximum pressure at a maximum flow rate. In the preferred embodiment, each selected set point is the maximum flow rate within the power limit of the prime mover for the previously set maximum pressure. Thus, for the FIG. 5 example to not exceed the curve 18 representing the power limit of the prime mover 14, the flow rate at point 80 is the maximum flow rate for the internal 2,500 psi setting of the pump 12; the flow rate at point 82 is the maximum flow rate for the relief valve 34 pressure limit; the flow rate at point 84 is the maximum flow rate for the relief valve 36 pressure limit; and the flow rate at point 86 is the maximum flow rate for the pump 12 and for the relief valve 38 pressure limit.

An important purpose of the present invention is to give a greater operating range to a hydraulic system having a power limited prime mover where maximum or peak pressure and maximum or peak flow rate are not simultaneously required. This invention reduces waste heat generated in parallel hydraulic systems because it provides high start-up pressures at low flows and then automatically decreases pressure as flow increases and the load or loads start moving. Less waste heat results in longer system life, decreased maintenance, and reduced fatigue of pumps and piping. It also allows smaller heat exchanger or cooling systems to be used to cool the prime mover and variable displacement pump. The present invention, whether through original manufacturing or retrofitting, accommodates any variable displacement pump that regulates system pressure based on the amount of back pressure held on an externally accessible port. The present invention provides a more efficient, flexible and cost-effective solution to the previously limited operating range of a variable displacement pump driven by a power limited prime mover.

Thus, the present invention is well adapted to carry out the objects and attain the ends and advantages mentioned above as well as those inherent therein. While the preferred embodiment of the invention has been described for the purpose of this disclosure, changes in the construction and arrangement of parts and the performance of steps can be made by those skilled in the art, which changes are encompassed within the spirit of this invention as defined by the appended claims.

What is claimed is:

1. An apparatus for controlling a variable displacement pump having a pressure responsive control port, comprising:

pressure setting means for setting a selectable pressure limit at the pressure responsive control port;

flow select means for selecting a plurality of flow rates at which said pressure setting means is to be operated; and control means for operating said pressure setting means to select a pressure limit for the pressure responsive control port in response to said flow select means and the actual flow rate of a flow from the pump.

2. An apparatus as defined in claim 1, wherein each of the plurality of flow rates of said flow select means is the flow rate defining a constant power output with a respective one of the selectable pressure limits of said pressure setting means.

3. An apparatus as defined in claim 1, wherein said pressure setting means includes:

a plurality of relief valves, each of said relief valves opening at a different respective pressure by which a respective pump operating pressure limit is defined;

a plurality of control valves, each of said control valves connected to a respective one of said relief valves, said control valves interconnected so that said control valves operate in unison in response to said control means; and means for connecting said control valves to the control port of the pump.

4. An apparatus as defined in claim 3, wherein said means for connecting includes a primary valve operable in response to said control mean to close the control port of the pump when said primary valve is in a first position and to open the control port of the pump to said control valves when said primary valve is in a second position.

5. A pumping system for providing a pressurized fluid flow at pressure and flow rate combinations within the range between a maximum pressure, minimum flow rate combination and a minimum pressure, maximum flow rate combination, comprising:

a pressure compensated variable displacement pump having a pressure responsive control port;

a flow meter connected to an output of said pump;

valve means, connected to said control port of said pump, for defining a plurality of pressure limits for said control port; and means, connected to said flow meter and said valve means, for operating said valve means to select which of said pressure limits is communicated with said control port of said pump in response to said flow meter indicating fluid is being pumped by said pump at one of a plurality of predetermined flow rates.

6. A pumping system as defined in claim 5, further comprising a prime mover connected to said pump, said prime mover providing a maximum power output less than the corner power which would be needed to provide the pressurized fluid at a maximum pressure, maximum flow rate combination.

7. A pumping system as defined in claim 6, wherein each of said predetermined flow rates is the respective flow rate requiring maximum power from said prime mover for the pressure limit to be communicated to said control port for flow rates less than that respective flow rate.

8. A pumping system as defined in claim 5, wherein said valve means includes:

a plurality of relief valves, each of said relief valves responding to a different respective maximum pressure; and a plurality of control valves which communicate a selected one of said relief valves with said control port of said pump in response to said operating means.

9. A pumping system as defined in claim 8, wherein said operating means includes:

means for entering a plurality of flow rate set points defining the flow rates at which said operating means selects which of said relief valves is communicated with said control port of said pump; and means for comparing said set points with the actual flow rate received from said flow meter for determining when a different relief valve is to be communicated with said control port.

10. A method of operating a variable displacement pump within the power limits of a prime mover but throughout a range of pressure-flow rate combinations, comprising:

monitoring the flow rate of a flow pumped by the variable displacement pump; and limiting the maximum pressure at which the pump pumps the flow in response to the monitored flow rate, wherein limiting the maximum pressure includes:

selecting a plurality of flow rate set points at which the pump is to be limited to different respective maximum pressures;

determining when the monitored flow rate equals one of the selected flow rate set points; and communicating one of a plurality of relief valves with a control port of the pump in response to determining the monitored flow rate equals one of the selected flow rate set points, each of the relief valves responsive to a different maximum pressure.

11. A method as defined in claim 10, wherein each selected flow rate set point is the maximum flow rate within the power limit of the prime mover for the previously set maximum pressure.

12. A method of operating a variable displacement pump within the power limits of a prime mover but throughout a range of pressure-flow rate combinations, comprising:

monitoring the flow rate of a flow pumped by the variable displacement pump; and limiting the maximum pressure at which the pump pumps the flow in response to the monitored flow rate, wherein limiting the maximum pressure includes:

setting the pump to operate up to a first maximum pressure;

determining when the monitored flow rate equals the flow rate at which the power limit of the prime mover is reached for the first maximum pressure; and resetting the pump to operate up to a second maximum pressure less than the first maximum pressure.

13. A method as defined in claim 12, wherein limiting the maximum pressure further includes repeating said determining and resetting for the second and additional sequentially smaller maximum pressures down to a last maximum pressure so that the pump provides flows at pressure and flow rate combinations between the first maximum pressure at a minimum flow rate and the last maximum pressure at a maximum flow rate.

14. A method of operating a variable displacement pump within the power limits of a prime mover but throughout a range of pressure-flow rate combinations, comprising:

monitoring the flow rate of a flow pumped by the variable displacement pump; and limiting the maximum pressure at which the pump pumps the flow in response to the monitored flow rate, wherein limiting the maximum pressure includes operating the pump at a higher maximum pressure until the monitored flow rate reaches the flow rate at which the power limit of the prime mover is reached and then operating the pump at a lower maximum pressure.

* * * * *